United States Patent [19]

Streubel

[11] Patent Number: 4,834,167

[45] Date of Patent: May 30, 1989

[54] MOLD FOR CONTINUOUSLY CASTING STEEL STRIP

[75] Inventor: Hans Streubel, Erkrath, Fed. Rep. of Germany

[73] Assignee: SMS Schloemann-Siemag Aktiengesellschaft, Dusseldorf, Fed. Rep. of Germany

[21] Appl. No.: 220,020

[22] Filed: Jul. 15, 1988

[30] Foreign Application Priority Data

Jul. 18, 1987 [DE] Fed. Rep. of Germany ..... 3723857

[51] Int. Cl.[4] ..... B22D 11/04

[52] U.S. Cl. ..... 164/418

[58] Field of Search ..... 164/418, 459

[56] References Cited

U.S. PATENT DOCUMENTS 4,721,151 1/1988 Streubel ..... 164/418

*Primary Examiner*—Kuang Y. Lin

*Attorney, Agent, or Firm*—Herbert Dubno; Andrew Wilford

[57] ABSTRACT

A continuous-casting mold for strip steel has cooled broad side walls have inner surfaces bridged by and forming an upwardly open cavity with narrow walls. Liquid metal is continuously introduced from the lower end of a pouring tube into the top of and withdrawn from the bottom of the mold such that the liquid metal has an upper surface at a predetermined normally stationary level in the mold. The inner surfaces are each formed by a planar lower portion wholly below the level, a central portion offset inward from the end walls and extending from the respective lower portion up above the level, a pair of planar intermediate portions coplanar with the respective lower portion, wholly below the level, and each extending between the respective central portion and a respective one of the narrow walls, and a pair of planar upper portions coplanar with each other, extending from the respective intermediate portions upward past the level, and flanking the respective central portion above the respective intermediate portions. The upper portions of each of the side walls diverge upward from and form an angle of between 1° and 3° with a vertical symmetry plane bisecting the end walls. The lower portions extend parallel to each other the full width of the mold between the end walls and the central portions flank the pouring tube lower end and diverge upward. The narrow walls are of uniform horizontal width below the upper portions and are of a width increasing uniformly upward along the upper portions.

2 Claims, 1 Drawing Sheet

MOLD FOR CONTINUOUSLY CASTING STEEL STRIP

FIELD OF THE INVENTION

The present invention relates to a continuous-casting mold. More particularly this invention concerns such a mold used for the manufacture of steel strip.

BACKGROUND OF THE INVENTION

In continuous casting, liquid metal is poured into the upper end of the vertically throughgoing cavity of a mold that is cooled so that before the metal reaches the lower end of the cavity at least the outer portions of the liquid-metal mass are hard enough to form a coherent shape that is pulled from the mold as a continuous strand. When steel strip is being formed the mold has two broad side walls bridged at their ends by two narrow walls. Granular additives are added at the top of the mold to form a protective and lubricating slag.

In order to make the faces of the strip as smooth as possible it has been suggested in European patent application No. 1,149,734 and in my earlier U.S. Pat. No. 4,721,151 to flare the mold cavity at an upper central region where the liquid metal is introduced into the mold, that is shape the cavity in this region so its flow cross section decreases downward. In the center of the top of the cavity the inside surfaces of the broad side walls of the mold are cut back to achieve this effect. End regions of these inner surfaces are parallel to each other so that the tapering only actually exists at the upper region of the mold cavity in its center.

Such a system somewhat reduces surface imperfections in the steel strip produced, but still leaves a substantial number of flaws, particularly near the edges of the strip. The improvement is evidently caused by entraining a small amount of the slag from atop the melt down along the sides of the mold. The resultant lubrication substantially eliminates wavy marks on the faces of the steel strip thus produced.

OBJECTS OF THE INVENTION

It is therefore an object of the present invention to provide an improved continuous-casting mold.

Another object is the provision of such a continuous-casting mold which overcomes the above-given disadvantages, that is which produces strip substantially free of surface imperfections.

A further object is to provide an improved continuous-casting system embodying the inventive mold.

SUMMARY OF THE INVENTION

A continuous-casting mold for strip steel has, as is known, broad side walls having inner surfaces bridged by and forming an upwardly open cavity with narrow walls. Liquid metal is continuously introduced from the lower end of a tube into the top of and withdrawn from the bottom of the mold such that the liquid metal has an upper surface at a predetermined normally stationary level in the mold. According to the invention the inner surfaces are each formed by a generally planar lower portion wholly below the level, a central portion offset inward from the end walls and extending from the respective lower portion up above the level, a pair of generally planar intermediate portions substantially coplanar with the respective lower portion, wholly below the level, and each extending between the respective central portion and a respective one of the end walls, and a pair of generally planar upper portions substantially coplanar with each other, extending from the respective intermediate portions upward past the level, and flanking the respective central portion above the respective intermediate portions. The upper portions of each of the side walls diverge upward from and form a angle of between 1° and 3° with vertical symmetry plane bisecting the end walls. The lower portions extend substantially parallel to each other the full width of the mold between the end walls and the central portions flank the pouring tube lower end and diverge upward. The narrow walls are of substantially uniform horizontal width below the upper portions and are of a width increasing uniformly upward along the upper portions.

In addition according to this invention the upper portions have lower edges abutting the respective intermediate portions and lying between 20 mm and 60 mm below the level of the liquid metal. Furthermore the side walls are substantially identical and the mold is symmetrical to a vertical plane bisecting the end walls.

DESCRIPTION OF THE DRAWING

The above and other objects, features, and advantages will become more apparent from the following, reference being made to the accompanying drawing in which.

SPECIFIC DESCRIPTION

Figure 3:
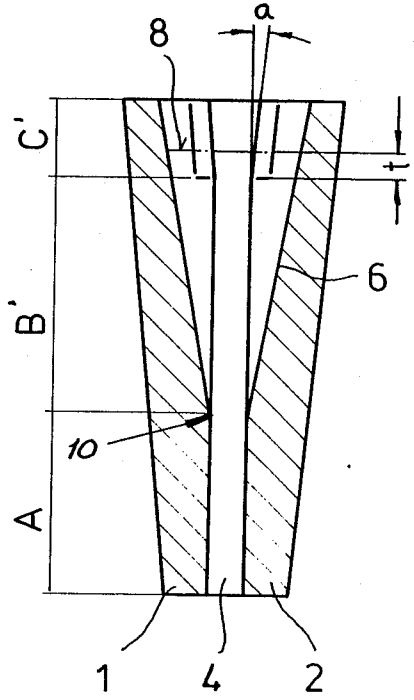
FIG. 3 is a section taken along line III—III of FIG. 1.
Figure 1:
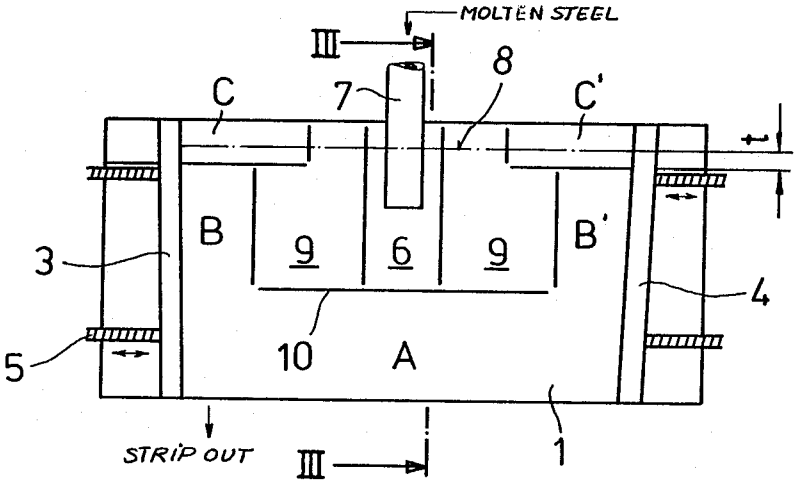
FIG. 1 is a side view of the mold according to this invention.
Figure 2:
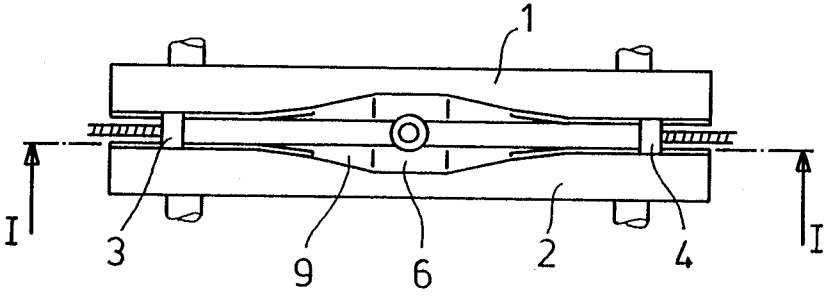
FIG. 2 is a top view of the mold, with line I—I showing the section plane of FIG. 1.

As seen in the drawing a mold for the continuous casting of steel strip is basically formed of two broad-side walls 1 and 2 and two narrow walls 3 and 4, the latter being displaceable by spindle-type adjusters 5 to vary the width of the strip being produced. The walls 1 through 4 form a vertically throughgoing cavity that is widened at its upper end a a central region 6 into which extends a pouring tube 7 that serves as part of the means which fills the mold with liquid metal to a level 8 just below the upper end of the mold. A layer of slag lies atop the melt above the level 8.

As is known the broad side walls 1 and 2 are cooled, typically by flowing water through them, so that the bath of metal in the mold cools from the outside in. This forms a coherent metallic skin on the bath of metal by the time it leaves the lower end of the mold, and subsequently the entire continuous strand thus produced cools and hardens so that it can be rolled and further treated downstream in the production path.

The inner surfaces of the broad side walls 1 and 2 are each formed by a generally planar lower portion A wholly below the level, a central portion 6, 9 offset inward from the narrow walls 3 and 4 and extending from the respective lower portion A up above the level, a pair of generally planar intermediate portions B and B′ substantially coplanar with the respective lower portion A, wholly below the level, and each extending between the respective central portion 6, 9 and a respective one of the narrow walls 3 and 4, and a pair of generally planar upper portions C and C′ substantially coplanar with each other, extending from the respective intermediate portions B and B′ upward past the level, and flanking the respective central portion 6, 9 above the respective intermediate portions B and B'.

The central portions 6, 9 are each formed by a planar center region 6 flanked by a pair of nonplanar regions 9 all meeting the lower portion A at a rounded edge 10. The upper portions C and C' of one of the broad side walls diverge upward from and form a angle a of between 1° and 3° with the vertical symmetry plane bisecting the end walls. The lower portions A extend substantially parallel to each other the full width of the mold between the end walls 3 and 4 and the central portions 6, 9 flank the pouring tube lower end and diverge upward. The end walls 3 and 4 are of substantially uniform horizontal width below the upper portions C and C' and are of a width increasing uniformly upward along the upper portions C and C'.

The upper portions C and C' have lower edges abutting the respective intermediate portions B and B' and lying a distance t of between 20 mm and 60 mm below the level of the liquid metal. Furthermore the broad side walls 1 and 2 are substantially identical and the mold is symmetrical to a vertical plane bisecting the end walls 3 and 4.

I claim:

1. In a continuous-casting mold for strip steel wherein relatively long side walls have inner surfaces bridged by and forming an upwardly open passage with relatively short end walls and wherein liquid metal is continuously introduced from the lower end of a dip tube into the top of and withdrawn from the bottom of the mold such that the liquid metal has an upper surface at a predetermined normally stationary level in the mold, the improvement wherein:

the side walls are substantially identical and the mold is substantially symmetrical to a vertical plane bisecting the end walls;

the inner surfaces are each formed by:

a generally planar lower portion wholly below the level, the lower portions extending substantially parallel to each other the full width of the mold between the end walls;

a central portion offset inward from the end walls and extending from the respective lower portion up above the level, the central portions flanking the dip-tube lower end and diverging upward;

a pair of generally planar intermediate portions substantially coplanar with the respective lower portion, wholly below the level, and each extending between the respective central portion and a respective one of the end walls; and a pair of generally planar upper portions substantially coplanar with each other, extending from the respective intermediate portions upward past the level, and flanking the respective central portion above the respective intermediate portions, the upper portions of each of the side walls diverging upward from and forming an angle of between 1° and 3° with the vertical symmetry plane of the mold; and the end walls are of substantially uniform horizontal width below the upper portions and are of a width increasing uniformly upward along the upper portions.

2. The continuous-casting mold defined in claim 1 wherein the upper portions have lower edges abutting the respective intermediate portions and lying between 20 mm and 60 mm below the level of the liquid metal.

* * * * *